United States Patent [19]

Binder

[11] Patent Number: 4,621,586

[45] Date of Patent: Nov. 11, 1986

[54] WORKPIECE HOLDING DEVICE

[75] Inventor: Hans Binder, Vienna, Austria

[73] Assignee: USM Corporation, Farmington, Conn.

[21] Appl. No.: 731,169

[22] Filed: May 6, 1985

[51] Int. Cl.[4] ..... D05B 21/00

[52] U.S. Cl. ..... 112/121.12; 12/146 C

[58] Field of Search ..... 112/121.12, 121.15, 112/262.1, 265.1, 121.11, 2, 102, 103, 311, 303; 12/146 C, 146 R, 142 LC; 223/38

[56] References Cited

U.S. PATENT DOCUMENTS 3,405,670 10/1968 Scholl et al. ..... 112/121.12

3,930,454 1/1976 Perlino ..... 223/38 X 3,988,993 11/1976 Brophy ..... 12/146 C X 4,455,952 6/1984 Morin et al. ..... 112/102 X 4,510,876 4/1985 Garley et al. ..... 112/262.1

*Primary Examiner*—Peter Nerbun

*Attorney, Agent, or Firm*—William F. White

[57] ABSTRACT

A workpiece holding device for use with automatic sewing machines includes registration and holding elements that securely hold a number of pieces of work relative to each other while allowing the same to be automatically sewn together. One of the holding elements moves from its respective holding position to a remote position as the pieces are being joined together.

14 Claims, 11 Drawing Figures

WORKPIECE HOLDING DEVICE

FIELD OF THE INVENTION

This invention relates to devices for holding workpieces that are to be sewn by automatic sewing machines. In particular, this invention relates to a workpiece holding device that may be used to hold several separate pieces of work relative to each other so as to facilitate sewing by an automatic sewing machine.

BACKGROUND OF THE INVENTION

Various workpiece holding devices have been used to positively clamp and hold a workpiece that is to be sewn by an automatic sewing machine. The workpiece is usually registered within the holding device and thereafter positively clamped for sewing. One example of such a device is illustrated in U.S. Pat. No. 3,988,993 to Brophy. This workpiece device utilizes a series of hinged leaves having cavities therein to precisely register various pieces of the workpiece relative to each other. Access by the sewing needle to the registered pieces within the cavities is via openings in the top and bottom leaves of the workholding device. The sewing needle passes through these openings as the workpiece holder is successively positioned underneath the reciprocating sewing needle. It is to be appreciated that the sewing needle must at all times be able to completely pass through a workpiece located within the workpiece holding device. There can, of course, be no interference with the solid metal portions of the workpiece holding device during this penetration of the workpiece. It is to be appreciated that the more extensive the path of the sewing needle becomes, the more difficult it is to provide suitable openings in the top and bottom which would allow for all such sewing to occur.

Other examples of workpiece holding devices are illustrated for instance in U.S. Pat. Nos. 4,171,672 to Dorosz et al and U.S. Pat. No. 4,455,952 to Morin et al. The workpiece devices in these patents have holding members that positively clamp the pieces of work therebetween. These holding members must also allow for penetration of the workpiece by the sewing needle. This often leads to rather complicated shapes which must sufficiently hold one or more pieces constituting the workpiece while allowing the same to be automatically sewn.

OBJECTS OF THE INVENTION

It is an object of this invention to provide a workpiece holding device that allows a workpiece to be accessed for sewing in an efficient manner by an automatic sewing machine.

It is another object of this invention to provide a workpiece holding device that holds multiple pieces of work that are to be sewn together in an efficient manner by an automatic sewing machine.

SUMMARY OF THE INVENTION

The above and other objects are accomplished according to the present invention by providing a workpiece holding device that holds a number of pieces of work in precise registration while allowing the sewing needle to have complete and total access to the thus held pieces of work. This is accomplished in part by the shape of an outwardly extending registration plate which allows various pieces of the workpiece to be easily registered with respect to each other. The thus registered pieces are held in place by a first holding member which pivots downwardly into place over the thus registered pieces. A second holding member is now moved from a remote position to a position first over and then downwardly into contact with the registered pieces. The resultingly held workpiece is exposed enough to allow the sewing needle to pursue a first sewing path over the workpiece. At a predetermined time during sewing, the second holding member is moved away from the registered pieces so as to allow the sewing needle access to a previously unexposed portion of the workpiece. The movement of the second holding member is preferably accomplished in such a manner as to not interrupt the continuous sewing of the workpiece.

BRIEF DESCRIPTION OF THE DRAWINGS

The above and other features of the invention will now be particularly described with reference to the accompanying drawings in which.

DESCRIPTION OF THE PREFERRED EMBODIMENT

Figure 1:
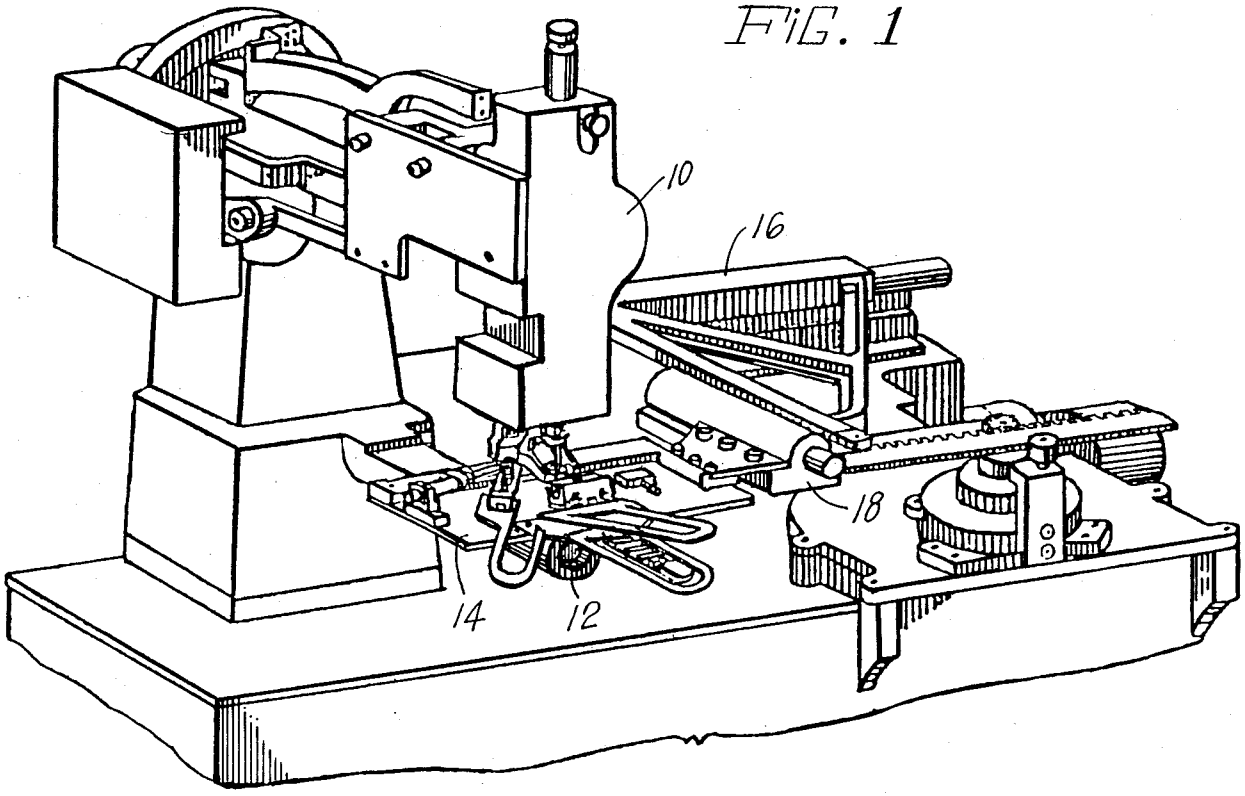
FIG. 1 is a perspective view of a sewing machine having a workpiece holding device in accordance with the invention.

Referring to FIG. 1, a sewing machine 10 having a post type of bed 12 with a workpiece holding device 14 resting thereon is generally illustrated. The workpiece holding device 14 is illustrated in an open condition prior to receiving a workpiece. It is to be noted that the workpiece holding device extends out over the end of the bed 12 so as to easily facilitate the loading of a workpiece. As will be explained in detail hereinafter, a workpiece is loaded into the device 14 and thereafter positively held in place by its various holding elements. The thus held workpiece is positioned underneath a reciprocating sewing needle of the sewing machine 10 by a positioning apparatus 16. The positioning apparatus 16 is preferably driven by electrical motors under the control of a digital control system. An example of such a positioning apparatus may be found in U.S. Pat. No. 4,312,282. It is to be noted that the workpiece holding device 14 is detachably connected to a movable carriage 18 of the positioning apparatus. The connection to the movable carriage 18 must be such as to essentially create a flat level relationship of the workpiece device with respect to the bed 12 of the sewing machine.

Figure 2:
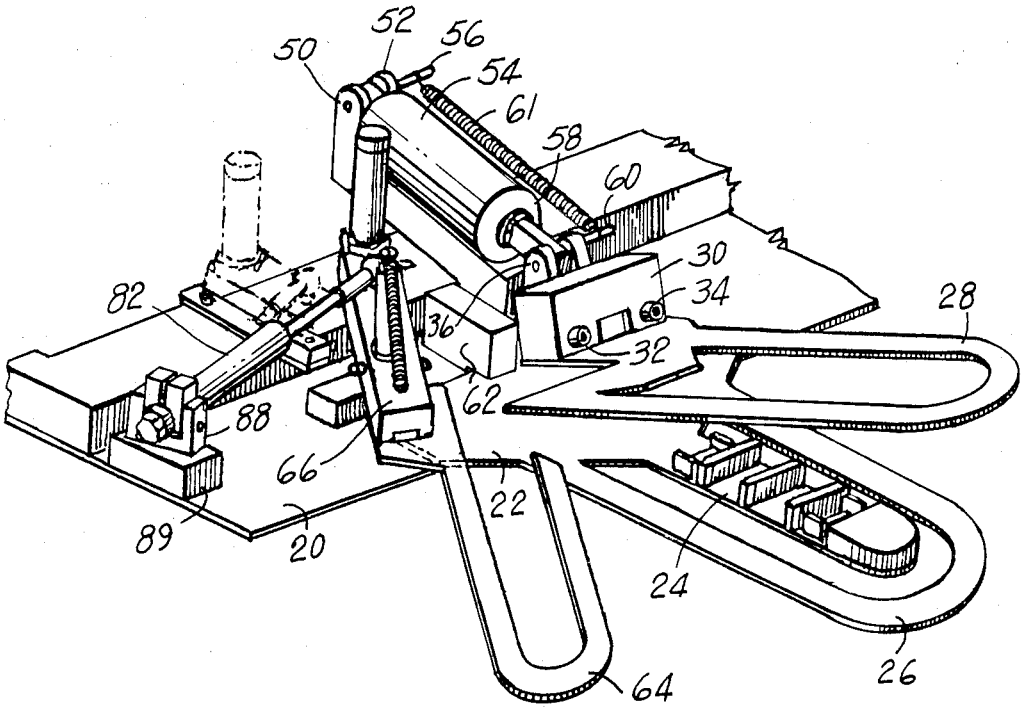
FIG. 2 is a perspective view of the workpiece holding device illustrated within the sewing machine of FIG. 1.

Referring now to FIG. 2, the workpiece holding device 14 is illustrated in further detail. In particular, the device is seen to comprise a base plate 20 which attaches to the movable carriage 18 of the positioning apparatus in FIG. 1. A workpiece registration plate 22 is attached to the base plate 20 and extends outwardly therefrom. The registration plate 22 is seen to include an island 24 with a series of raised projections thereon. An outer peripheral portion 26 of the registration plate extends around the island 24 and is spaced therefrom. A first holding member 28, having substantially the same peripheral shape as the outer peripheral portion 26 is pivotally mounted above the outer peripheral portion of the registration plate. In this regard, the first holding member 28 includes a rearwardly located mounting block 30 having threaded screws 32 and 34 which attach the mounting block 30 to a pivotal member 36.

Figure 3:
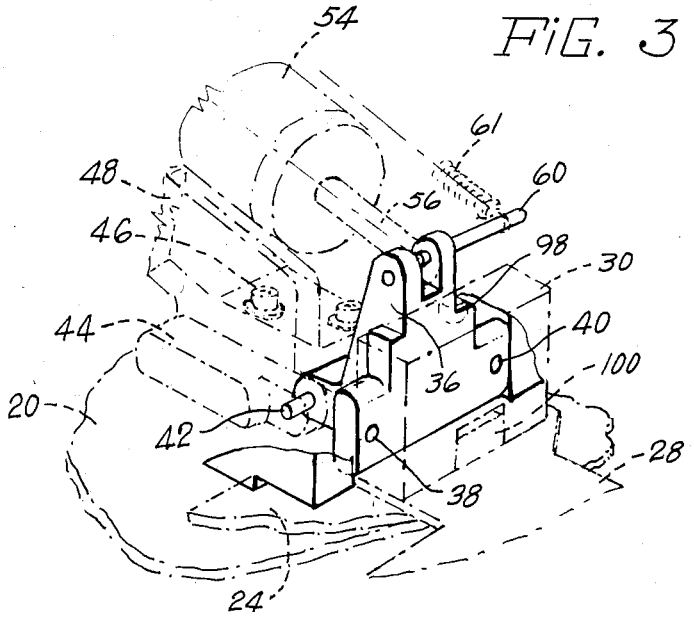
FIG. 3 is a view of a pivotal element within the workpiece holding device of FIG. 2.

Referring to FIG. 3, the pivotal member 36 is illustrated in detail relative to a dotted outline of the mounting block 30 and the rear portion of the holding member 28. The pivotal member 36 is seen to include a set of threadable holes 38 and 40 which receive the threaded screws 32 and 34. The pivotal member 36 is itself pivotally mounted on an axis member 42 which extends through a pair of stationary mounts, such as 44, to either side of a rear portion of the pivotal member. The stationary mounts are part of a mounting structure 48 which is fixedly attached to the base plate 20 by one or more threaded screws such as 46. The mounting structure 48 has a pair of upwardly extending mounts 50 and 52 in FIG. 2 which allow a rear portion of a pneumatic actuator 54 to be rotatably mounted to an axial member 56. The pneumatic actuator 54 furthermore has an extension 58 rotatably attached to an axial member 60 which is in turn connected to a yoke portion of the pivotal member 36. A tensioned spring 61 is connected between the axial members 56 and 60. The extension 58 of the pneumatic actuator 54 moves outwardly against the bias of the spring 61 so as to pivot the holding member 28 downwardly. The spring 61 returns the holding member 28 to an up position when air pressure is released from the pneumatic actuator 54. It is to be noted that the clamping member 28 is restrained from moving laterally during the aforementioned pivotal movements by a pair of guide blocks such as 62 located to either side of the mounting block 30.

Figure 4:
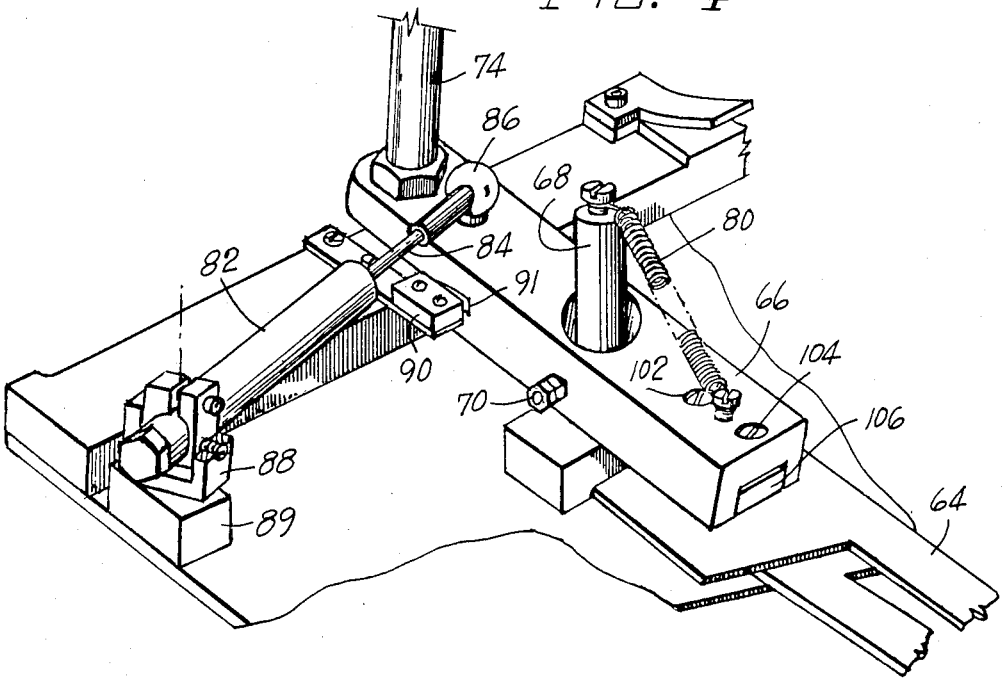
FIG. 4 is a perspective view of a portion of the workpiece holding device illustrated in FIG. 2.

When the holding member 28 has moved downwardly into place over the outer peripheral portion 26, a second holding member 64 is thereafter moved into place in a manner which will now be described. The holding member 64 includes a rearwardly attached arm 66 which is rotatably attached to a post 68 via a pivot pin 70 as is illustrated in FIG. 4. The post 68 is itself rotatable within a base 72 attached to the base plate 20 in the manner illustrated in FIG. 5. It is hence to be appreciated that the holding member 64 may be pivoted up or down about the pivot pin 70. The holding member 64 may also be rotated about an axis through the post 68 so as to move toward or away from the registration plate 22 and the holding member 28.

Figure 5:
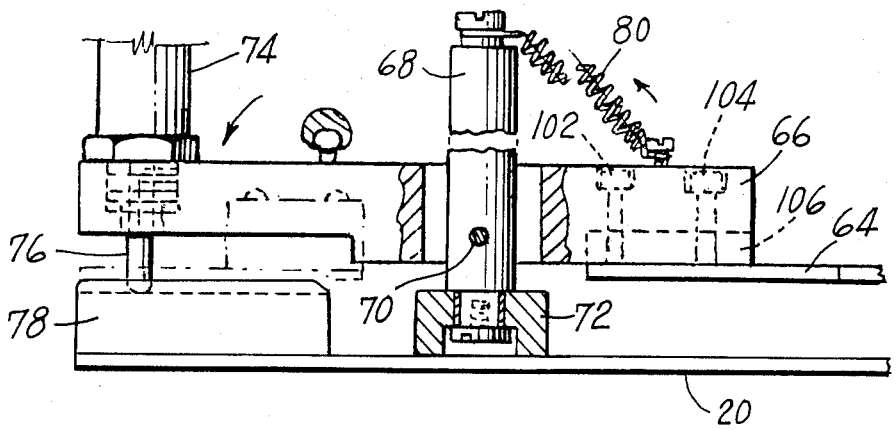
FIG. 5 is an elevational view of that portion of the workpiece holding device illustrated in FIG. 4.

The means for pivoting the holding member 64 about the pivot pin 70 comprises a pneumatic actuator 74 fixedly attached to the rear portion of the arm 66 as is shown in FIGS. 4 and 5. Referring to FIG. 5, the pneumatic actuator 74 is seen to have an extension 76 that extends through a hole in the arm 66 so as to contact a back plate 78 attached to the base plate 20. The end of the extension 76 must freely move on the surface of the back plate 78 so as to accommodate the rotation of the arm 66 about the axis through the rotatable post 68. The extension 76 is illustrated in a downward, fully extended position in FIG. 5. This results in the holding member 64 being in a downward position relative to the registration plate 22. It is to be noted that the holding member 64 is moved to an upward position by exhausting the air from the pneumatic actuator 74 so as to thereby allow a tensioned spring 80 to pull the arm 66 upwardly. It is furthermore to be noted that the upward position of the holding member 64 as defined by the pneumatic actuator 74 is substantially lower than the upward position of the holding member 28. This is because the holding member 64 need only be pivoted upwardly to a position wherein it is above any portion of the registration plate 22 inclusive of the raised projections on the island 24. At this point, the holding member may be pivoted outwardly without interfering with any portion of the registration plate 22.

The holding member 64 is caused to rotate both inwardly and outwardly relative to the registration plate 22 by the action of a pneumatic actuator 82. Referring to FIG. 4, an extension 84 of the pneumatic actuator 82 is connected through a ball joint 86 to the arm 66. The ball joint allows for both the rotation of the arm 66 by the actuator 82 as well as the up and down action of the arm 66 by the actuator 74 in combination with the spring 80. The rear of the pneumatic actuator 82 is pivotally connected to a support 88 which is in turn rotatably connected to a mount 89.

It is to be noted that a contact switch 90 having a contact 91 is normally in contact with the arm 66 when the pneumatic actuator 82 is in a retracted position. This represents a closed switch conditon indicating that the pneumatic actuator has yet to rotate the holding member 64 outwardly.

Figure 6:
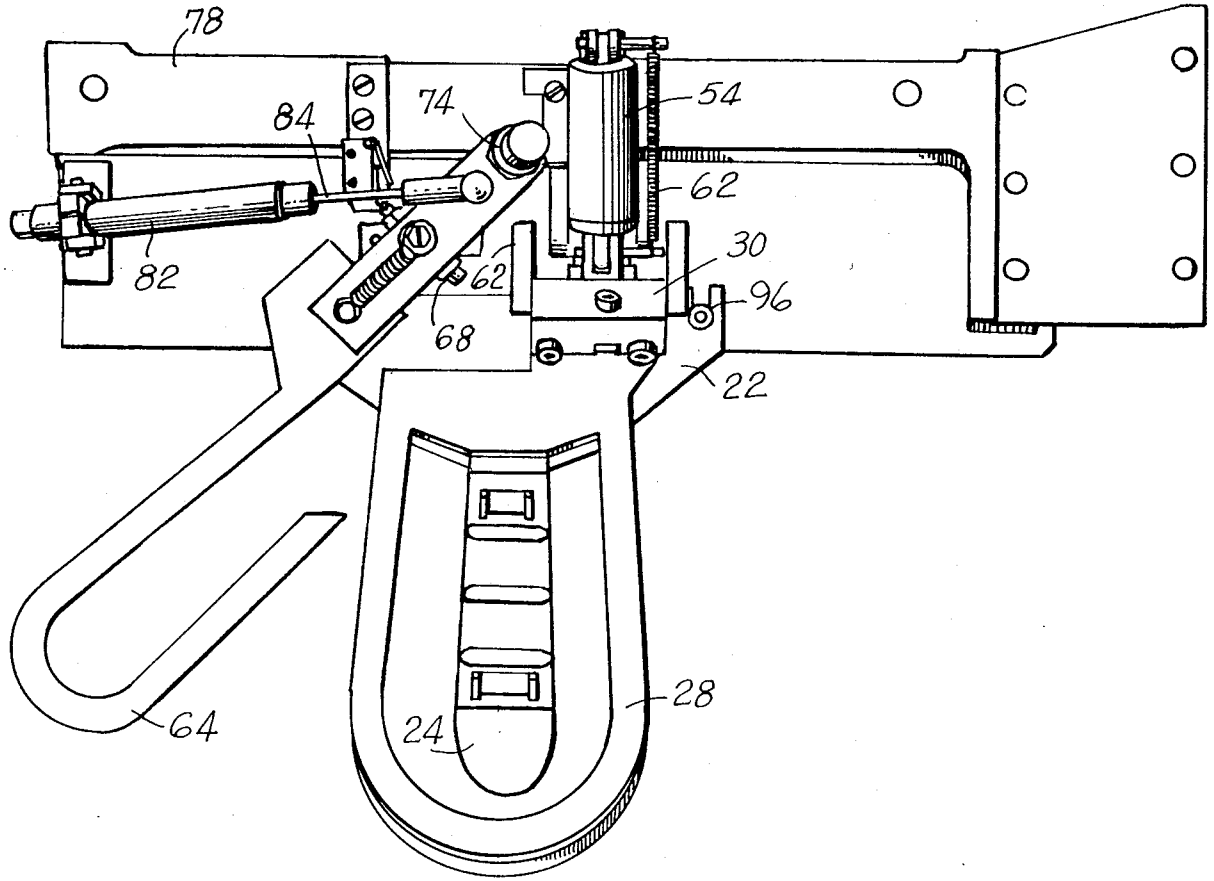
FIG. 6 is a plan view of the workpiece holding device of FIG. 2 before actuation of a particular holding member.
Figure 7:
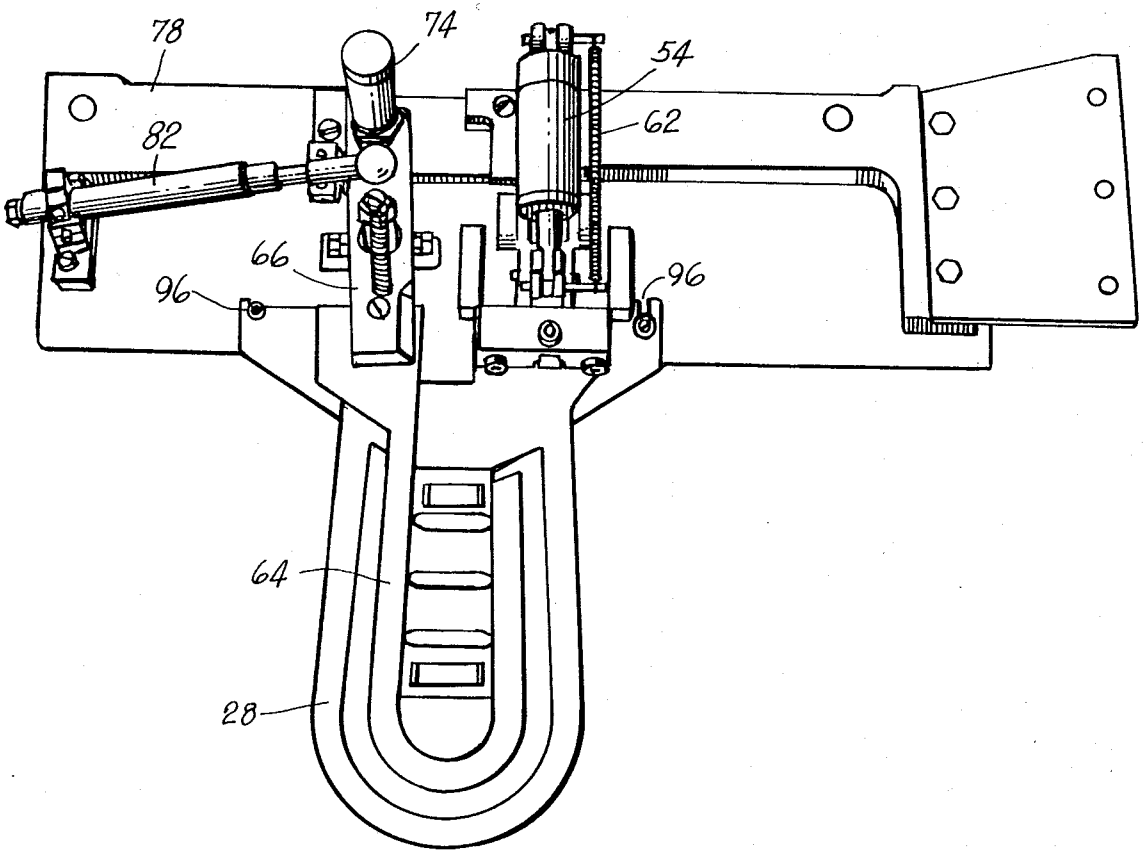
FIG. 7 is a plan view of the workpiece holding device of FIG. 2 after actuation of the particular holding member.

Refer now to FIGS. 6 and 7 wherein the movement of the holding members 28 and 64 can be observed. The holding member 64 is depicted in an outward remote position in FIG. 6 and in an inward position in FIG. 7. It is hence to be appreciated that the switch 90 will be in a open state in FIG. 6 and in a closed state in FIG. 7. The sequential operation of the pneumatic actuators 54, 74 and 82 in moving the holding members 28 and 64 will now be described. Referring first to FIG. 6, the pneumatic actuator 54 has been extended so as to cause the holding member 28 to move downwardly into position over the outer peripheral portion of the registration plate 22. At this time, a substantial open area exists between the island 24 of the registration plate and the thus positioned holding member 28. The holding member 64 is furthermore in the remote position due to the retracted state of the pneumatic actuator 74 and the extended state of the pneumatic actuator 82. The pneumatic actuator 82 is first retracted so as to rotate the arm 66 and hence the holding member 64 about the axis through the post 68. This brings the holding member into a position above the space between the island 24 and the holding member 28 as is shown in FIG. 7. The pneumatic actuator 74 is now extended so as to pivot the holding member 64 downwardly. It is to be appreciated that the action of each pneumatic actuator can be reversed in a sequence which first moves the holding member 64 upwardly and then outwardly to the remote position and thereafter pivots the holding member 28 upwardly. In each sequence, the pneumatic actuators are preferably activated by appropriate control signals from the automatic sewing machine.

It is to be appreciated that the registration plate 22 and holding members 28 and 64 form a complete set of clamps for a workpiece. Each has an interchangable connection with respect to a portion of the workpiece holding device. In this regard, the registration plate 22 has a set of slots such as 96 in FIGS. 6 and 7 which allow the registration plate to be easily registered and fastened to the base plate 22. On the other hand, the holding member 28 is threadably fastened to the mounting block 30 via a screw 98 which threadably engages a centering piece 100 that fits within a recess of the mounting block 30 as is seen in FIG. 3. Finally the holding member 64 attaches to the arm 66 via a set of screws 102 and 104 which threadably engage a centering block 106 located within a recess in the arm 66.

Figure 8:
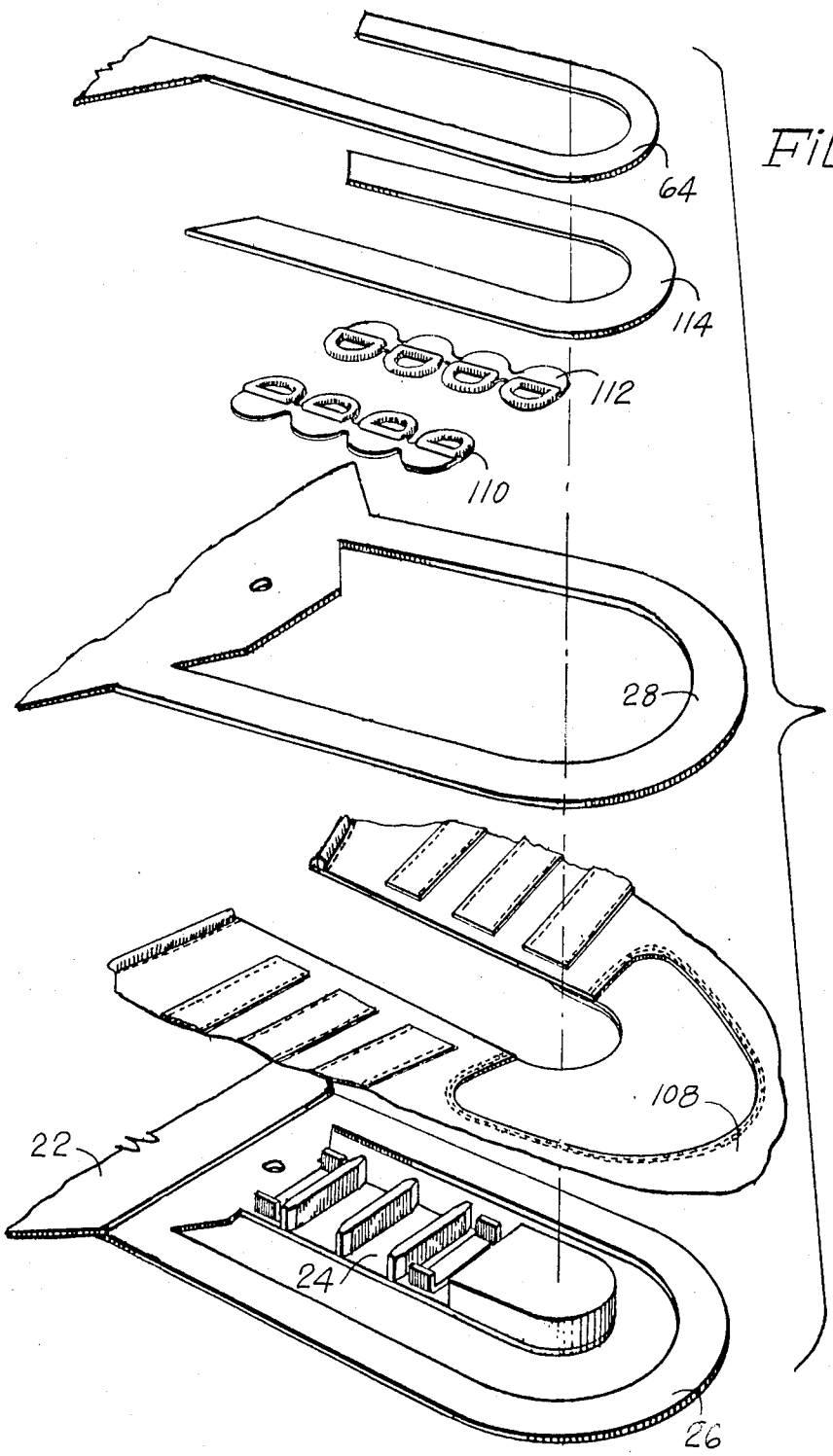
FIG. 8 is an exploded view of certain elements of the workpiece holding device illustrated in relation to pieces of a shoe that are to be held within the workpiece holding device.

Referring now to FIG. 8, a number of individual pieces of a workpiece are illustrated in exploded fashion relative to the registration plate 22 and the holding members 28 and 64. The pieces comprise various portions of a shoe and are specifically denoted as a shoe upper body 108, a pair of integrally formed plastic eyelets 110, 112 and an eyelet coverpiece 114. The particular join and sew operation to be accomplished is that of stitching through the eyelet coverpiece 114, the eyelets 110 and 112, and the shoe upper body 108. The process of registering and thereafter sewing these particular pieces of a shoe are the subject of commonly assigned U.S. patent application Ser. No. 731,446, entitled "Automatic Join and Sew Process for Shoes" filed on even date herewith in the name of Hans Binder.

Figure 9:
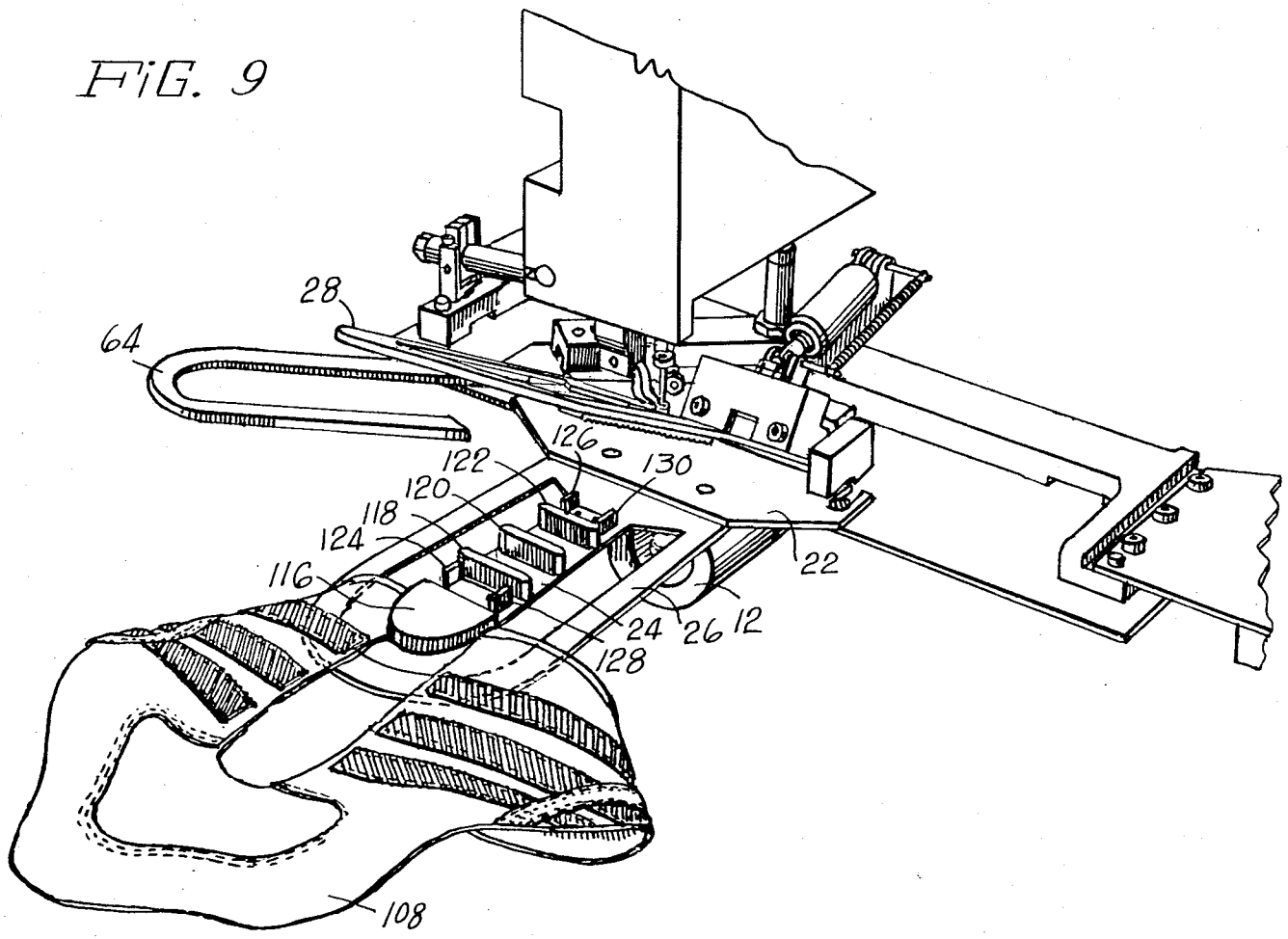
FIG. 9 is a perspective view of a first shoe piece bieng intially registered with respect to the workpiece holding device.

Referring now to FIG. 9, the shoe upper body 108 is being brought into initial registration with a front registration element 116 located on the island 24 of the registration plate 22. The inner periphery of the shoe upper body 108 registers first with the outer periphery of the front registration element 116 and thereafter with the edges of members 118, 120 and 122 which rise upwardly from the island 24. It is to be noted that the heel portion of the shoe upper body 108 has been previously joined in a separate shoe making operation. This is normally considered advantageous in the shoe making art. The thus joined heel portion will not present a problem to any further sewing of the shoe upper body 108 since the heel portion lies completely below the the post-bed 12 of the sewing machine.

Figure 10:
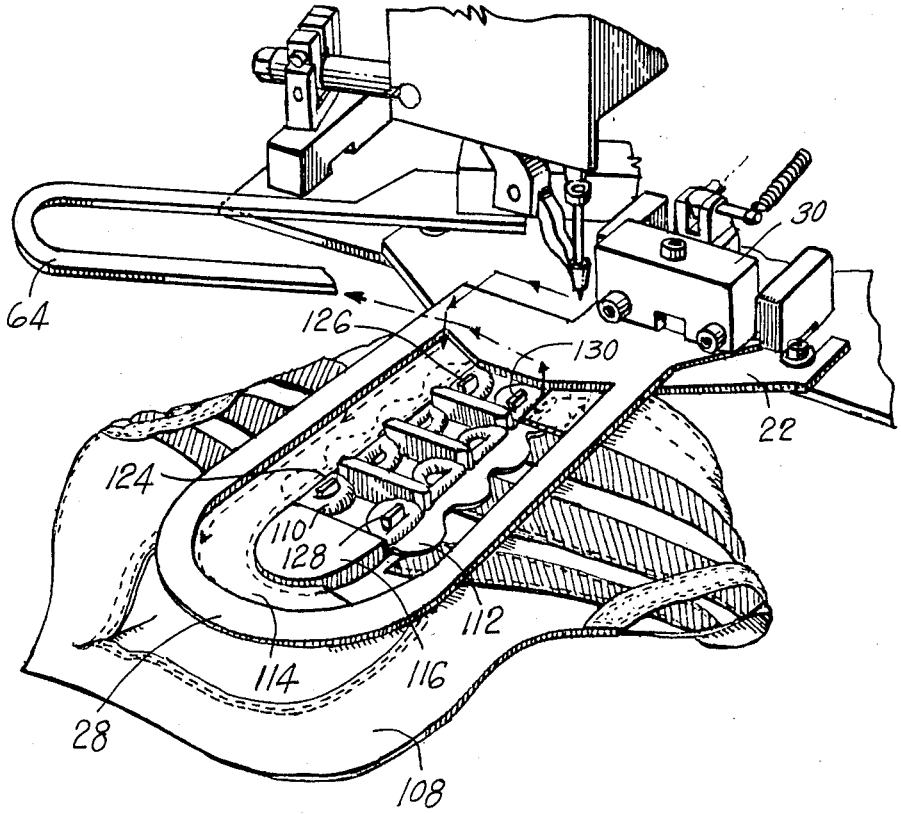
FIG. 10 is a perspective view of further shoe pieces being registered within the workpiece holding device.

Referring now to FIG. 10, the shoe upper body 108 has now been completely registered on the registration plate 22. In particular the inner periphery of the shoe upper body 108 has been brought into complete registration with both the periphery of the front registration element 116 as well as the edges of members 118, 120, and 122 which rise upwardly from the island 24. The holding member 28 has moreover been pivoted downwardly over the thus registered shoe upper body 108. The plastic eyelet pieces 110 and 112 are now positioned over the shoe upper 108. Specifically, the two end loops of the eyelet piece 110 are positioned over a pair of registration elements 124 and 126 whereas the two end loops of the eyelet piece 112 are positioned over a pair of registration elements 128 and 130. Members 118, 120 and 122 rising upwardly from the island 24 define individual channels wherein the separate loops of each eyelet piece can be positioned therein.

After having thus positioned the eyelet pieces 110 and 112 relative to the shoe upper body 108, it now remains to position the eyelet cover piece 114 thereover. In this regard, the eyelet cover piece 114 is placed into a space defined by the inner periphery of the holding element 28 and the out edges of the members 118, 120, 122, and the front registration member 116. This provides a complete inner and outer edge alignment for the thus inserted eyelet coverpiece 114.

Figure 11:
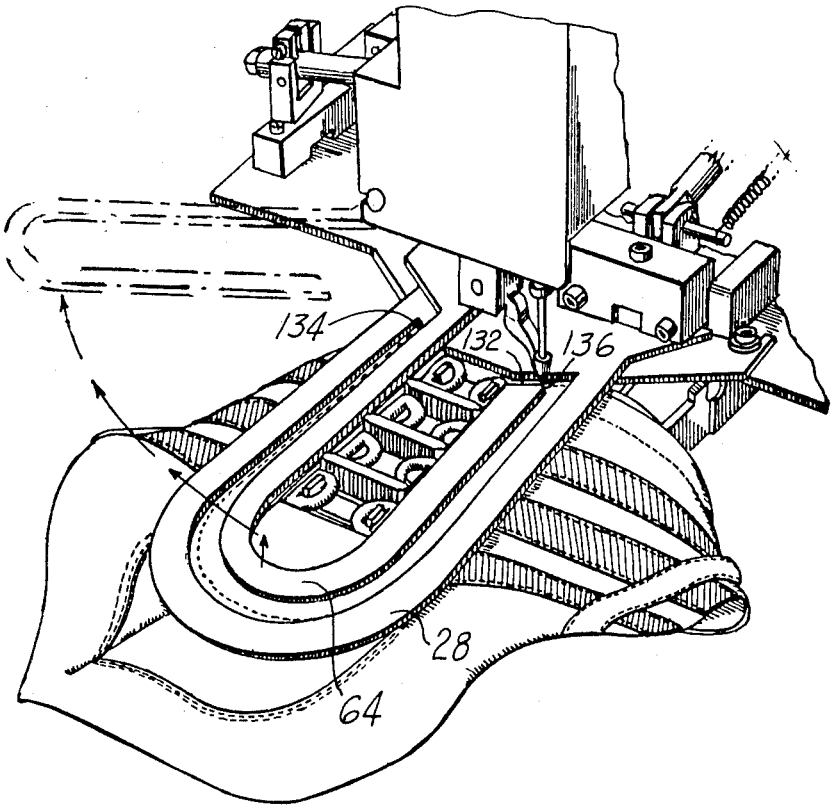
FIG. 11 is a perspective view of the workpiece holding device containing all registered pieces of the workpiece.

It is to be appreciated that the portion of each eyelet piece that is now covered by the eyelet cover piece 114 defines a rather irregular shape of appreciable thickness. The underlying eyelet pieces 110 and 112 would quite possibly produce an undersirable wrinkling of the eyelet cover piece 114 when successive stitches are formed in the coverpiece. The eyelet cover piece might also shift laterally during sewing. The above possible lateral shifting and/or wrinkling of the coverpiece is completely dispensed with by bringing the holding member 64 into position over the eyelet coverpiece 114 as is illustrated in FIG. 11. Referring briefly back to FIG. 7, it is to be noted that the inner periphery of the thus positioned holding member 64 will fit closely around the outer periphery of the island 24 and the various members rising upwardly therefrom. The outer periphery of the thus positioned holding member 64 will however be appreciably spaced from the inner periphery of the holding member 28 as is illustrated in FIG. 11. The end 132 of the holding member 64 will moreover terminate at a spaced distance from the inner periphery of the holding member 28. This allows the sewing needle to proceed along a sewing path (indicated by a dotted line) beginning at a point 134 and ending at a point 136 without interference with the holding member 64.

In accordance with the invention, the holding member 64 is released at a predetermined point upstream of the point 136. The release is preferably timed to occur in such a manner that the holding member 64 will be sufficiently displaced upwardly by the pneumatic actuator 74 and outwardly by the pneumatic actuator 82 so as to allow the sewing needle to proceed past the point 136 without any interruption in the continuous sewing of the pieces. This is preferably accomplished by providing a command within the control system of the automatic sewing machine that would authorize release of the holding member a predetermined number of stitches from the stitch point 136. Such a command would preferably reside in the pattern data stored within the pattern memory of the control system. The air to the pneumatic actuator 74 is released in response to the imbedded command causing the holding member 64 to pivot upwardly to an upward position. The actuator 82 is thereafter extended causing the holding member to move outwardly. It is to be noted that the sewing needle will only proceed beyond stitch point 136 if an open switch signal indication has been received from the switch 90. This will occur at such time as the pneumatic actuator 82 begins to extend thereby moving the holding member 64 from the upward position established by the release of pneumatic actuator 74. When such an open switch signal is present, the automatic control will cause the sewing needle to pursue an inner stitch path close to the periphery of the island 24. This will form a line of stitches on the eyelet cover piece 114 parallel to that of the first line of stitches. It is to be appreciated that the first line of stitches has adequately tacked down the eyelet cover piece 114 so that the stitching of the second line of stitches does not provide any undesired wrinkling of the eyelet coverpiece. The covered portions of the eyelet pieces 110 and 112 are moreover now firmly held in place by the first line of stitches which are themselves formed by holding down the eyelet pieces by the holding member 64.

It is to be appreciated that a workpiece holding device has been disclosed for use with an automatic sewing machine. The scope of this invention is not limited to the particular elements of the disclosed workpiece holding device.

What is claimed is:

1. A workpiece holding device for holding a number of separate pieces of work with respect to each other during sewing by an automatic sewing machine, said workpiece holding device comprising;

means for registering a base piece of the work in a predetermined position;

means for clamping the base piece of work to said registration means;

means, located on said registering means, for orienting at least one further piece of work relative to the base piece after the base piece of work has been clamped;

means for contacting the oriented one or more pieces of work in a predetermined area while the pieces are being partially sewn to the base piece; and means for automatically moving said contacting means from a position of contact with the oriented one or more pieces of work to a remote location of no contact with the oriented one or more pieces of work after the pieces have been partially sewn to the base piece so as to allow sewing to continue in the predetermined area previously contacted by said contacting means.

2. The workpiece holding device of claim 1 wherein said means for registering a base piece in a predetermined position comprises:

means, extending outwardly from the end of the bed of said automatic sewing machine, for registering an edge of the base piece; and means for substantially supporting the base piece in the predetermined position, said supporting means surrounding said outwardly extending means and being spaced therefrom so as to define an open space for accomodating a needle of an automatic sewing machine passing therethrough.

3. The workpiece holding device of claim 2 wherein said means for clamping the base piece of work to said means for registering a base piece conforms to the shape of said means for substantially supporting the base piece.

4. The workpiece holding device of claims 2 or 3 wherein said means for orienting at least one further piece of work relative to the base piece is located on said means extending outwardly from the end of the bed of said sewing machine for registering an edge of the base piece.

5. The workpiece holding device of claim 1 further comprising:

means for moving said clamping means in a pivotal arc between a position above said means for registering a base piece and a clamped position over the base piece of work.

6. The workpiece holding device of claim 5 wherein said means for automatically moving said contacting means comprises:

first means for moving said contacting means in a first pivotal arc to an upward postition which is of less height relative to said means for registering a base piece of work than the position above said means for registering a base piece occupied by said clamping means; and second means for moving said contacting means in a second pivotal arc from the upward position to the remote location whereby the clamping means may be thereafter pivoted between the clamped position and the position above said means for registering a base piece without interfering with the remotely located contacting means.

7. The workpiece holding device of claim 1 wherein said means for contacting the oriented one or more pieces of work in a predetermined area has an outer periphery substantially spaced from the inner periphery of said clamping means so as to allow a stitch path to be formed between said contacting means and said clamping means.

8. The workpiece holding device of claim 1 wherein said means for automatically moving said contacting means is responsive to the sewing needle having reached a predetermined point in the stitching of the one or more pieces of work to the base piece, said point being defined such that the sewing needle may continue to sew a predetermined number of stitches before entering the predetermined area contacted by said contacting means.

9. The workpiece holding device of claims 1 or 8 further comprising:

means for sensing a predetermined amount of movement of said contacting means when said contacting means is being moved from the contact position to the remote location, said sensing means being operative to authorize the sewing needle to continue stitching in the event that the predetermined amount of movement has been sensed.

10. The workpiece holding device of claim 1 wherein said means for automatically moving said contacting means comprises:

first means for moving said contacting means to an upward position above the partially sewn one or more pieces of work in response to the sewing needle having reached a predetermined stitch point; and seconds means for moving said contacting means from the upward position to an outward position whereby said contacting means is no longer directly above the one or more pieces of work.

11. The workpiece holding device of claim 10 further comprising:

means for authorizing stitching in the predetermined area of the one or more pieces of work previously contacted by said contacting means when said second moving means has begun to move said contacting means from the upward position.

12. The workpiece holding device of claim 11 wherein said means for authorizing stitching in the predetermined area of the one of more pieces of work previously contacted by said contacting means comprises:

means located within said workpiece holding device for sensing when said contacting means has begun to move from the upward position to the remote location.

13. The workpiece holding device of claim 10 wherein said first and second moving means move said contacting means in pivotal arcs between respective positions.

14. The workpiece holding device of claim 1 wherein said means for automatically moving said contacting means comprises:

first means for moving said contacting means in a first pivotal arc with respect to said means for registering a base piece of the work; and second means for moving said contacting means in a second pivotal arc, the second pivotal arc being distinct from the first pivotal arc.

* * * * *